United States Patent [19]

Pensa et al.

[11] Patent Number: 4,828,571

[45] Date of Patent: May 9, 1989

[54] NON-AQUEOUS PROCESS FOR THE DYEING OF DYABLE MATERIALS AT AN ELEVATED TEMPERATURE IN A NON-REACTIVE ENVIRONMENT AND IN A NON-AQUEOUS DYE SOLVENT

[76] Inventors: Ildo E. Pensa, 5 Staunton Ct., Greensboro, N.C. 27410; C. Duff Hughes, 2104 Cleburne, Greensboro, N.C. 27408; Nicholas S. Hood, Rt. #7, Ashboro, N.C. 27203; Eugene M. Saunders, 4 Lake Forest Ct., Greensboro, N.C. 27408

[21] Appl. No.: 862,196

[22] Filed: May 9, 1986

Related U.S. Application Data

[63] Continuation of Ser. No. 600,103, Apr. 13, 1984, abandoned.

[51] Int. Cl.[4] ..... D06B 9/02; D06P 1/90

[52] U.S. Cl. ..... 8/492; 8/506; 8/543; 8/580; 8/582; 8/583; 8/584; 8/614; 8/615; 8/618; 8/631; 8/650; 8/657; 8/922; 8/924; 8/925; 8/926; 8/927; 8/928

[58] Field of Search ..... 8/506, 938, 492, 580, 8/582, 583, 614, 615

[56] References Cited

U.S. PATENT DOCUMENTS

| | | | |
|---|---|---|---|
| 3,557,395 | 1/1971 | Kronshein | 8/149.2 |
| 3,558,267 | 1/1971 | Langenfeld | 8/586 |
| 3,771,949 | 11/1973 | Hermes | 8/492 |
| 3,790,342 | 2/1974 | Love et al. | 8/607 |
| 3,837,802 | 9/1974 | Litzer et al. | 8/549 |
| 3,871,821 | 3/1975 | Winn et al. | 8/149.1 |
| 3,884,626 | 5/1975 | Hoster et al. | 8/543 |
| 3,941,561 | 3/1976 | Love et al. | 8/581 |
| 3,973,908 | 8/1976 | Dunn, Jr. | 8/494 |
| 4,065,259 | 12/1977 | Jackson | 8/615 |
| 4,111,645 | 9/1978 | Zurbuchen et al. | 8/614 |
| 4,274,829 | 6/1981 | Zurbuchen | 8/475 |
| 4,293,305 | 10/1981 | Wilson | 8/115.6 |
| 4,459,704 | 7/1984 | Sears et al. | 264/292 |
| 4,550,579 | 11/1985 | Clifford | 68/5 C |
| 4,559,094 | 12/1985 | Hostetler et al. | 156/212 |

FOREIGN PATENT DOCUMENTS

| | | |
|---|---|---|
| 159877 | 4/1985 | European Pat. Off. . |
| 3520806 | 12/1986 | Fed. Rep. of Germany . |
| 1386073 | 3/1975 | United Kingdom . |
| 1386072 | 3/1975 | United Kingdom . |
| 1428781 | 3/1976 | United Kingdom . |
| 1428782 | 3/1976 | United Kingdom . |
| 1531034 | 11/1978 | United Kingdom . |
| 1536210 | 12/1978 | United Kingdom . |

OTHER PUBLICATIONS

J. Lenoir in Vemcataraman's "The Chemistry of Synthetic Dyes", (Academic Press), vol. V, p. 314.

European Patent Office Search Report, EP 85302577, dated Jan. 30, 1987.

*Primary Examiner*—A. Lionel Clingman

*Attorney, Agent, or Firm*—Finnegan, Henderson, Farabow, Garrett & Dunner

[57] ABSTRACT

The present invention provides a non-aqueous process for the dyeing of a dyeable material at an elevated temperature by contacting a dyeable material with a dye composition at an elevated temperature in a non-reactive environment. The dye composition temperature and the time of contact between the dye composition and the dyeable material are sufficient to effectuate the dyeing of the material. The dye composition comprises a substantially non-aqueous solvent and a dyestuff.

44 Claims, 8 Drawing Sheets

FIG. 15.
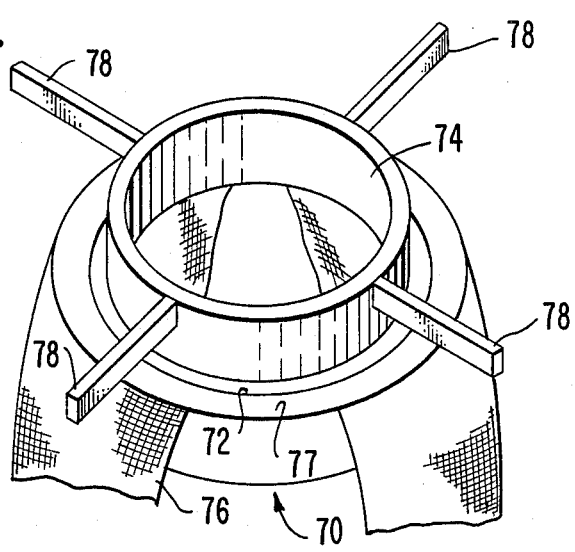
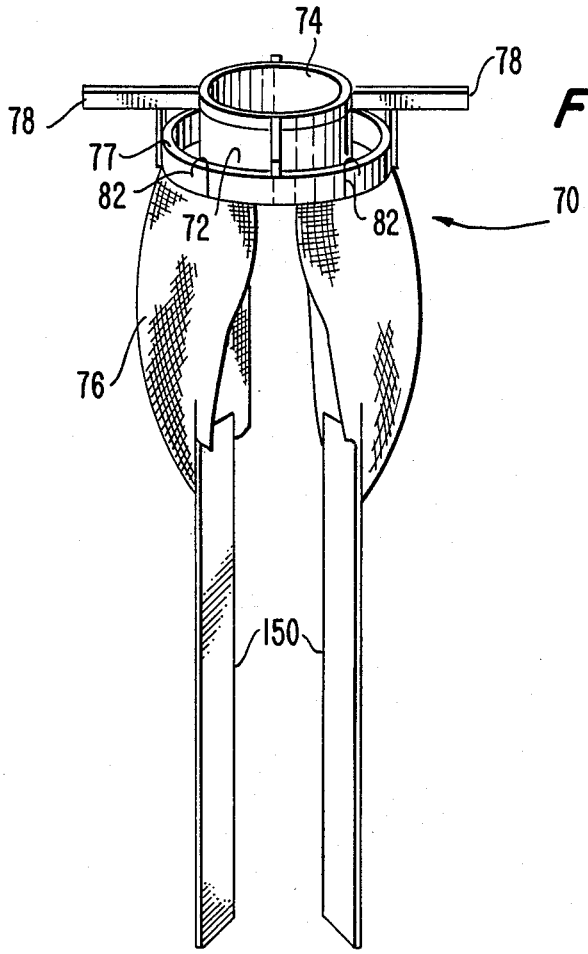
FIG. 16.
FIG. 17.
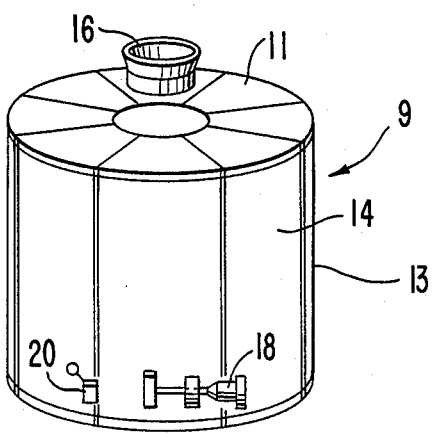

NON-AQUEOUS PROCESS FOR THE DYEING OF DYABLE MATERIALS AT AN ELEVATED TEMPERATURE IN A NON-REACTIVE ENVIRONMENT AND IN A NON-AQUEOUS DYE SOLVENT

This application is a continuation, of application Ser. No. 600,103, filed Apr. 13, 1984, abandoned.

FIELD OF THE INVENTION

The present invention relates to the dyeing of dyeable materials and, more particularly, it relates to a method of significantly reducing degradation of the dyestuff used in non-aqueous high temperature dyeing processes.

BACKGROUND OF THE INVENTION

The dyeing of dyeable materials, especially synthetic materials such as polyester, has previously been conducted with a dyestuff dispersed in an aqueous bath. The dyeable material is placed in the bath for a long enough time period to allow dyestuff to be absorbed to provide the desired coloration.

Such a dyeing process poses several disadvantages and limitations. Since the temperature of the aqueous bath cannot exceed the boiling temperature of the water, the process cannot be conducted at elevated temperatures unless high pressure is used. Even then, temperatures of only 250° F. to 270° F. are reached. Consequently, relatively long dyeing cycles are needed.

Additionally, the aqueous bath is generally disposed of after each dyeing cycle because most of the dyestuff has been absorbed by the dyeable material. The disposal of the used dye bath presents obvious environmental problems, as well as economic losses due to discharge of the residual dyestuff and chemicals remaining in the bath.

Dyeing at elevated temperatures with a non-aqueous system overcomes many of these problems and provides several advantages. Elevated temperatures reduce the time needed to dye the dyeable material. Shorter dyeing cycles make the process more economical and efficient.

Various dyeing processes that use non-aqueous dye compositions have been proposed for the treatment of dyeable materials. One technique involves immersing the dyeable material in a bath comprising an organic dyestuff dissolved in a high boiling aromatic ester or a cycloaliphatic diester. Such dyeing processes provide several disadvantages that prevent their effective and efficient use. The dye composition does not remain stable over a period of time when used in an ambient atmosphere and significant degradation of the dye composition often occurs after only a few hours of use.

It was initially believed that the stability problem could be eliminated by varying the chemical properties or components of the dye composition. Thus, in an attempt to solve the problem, the diester component was replaced by a modified diester, i.e., an adduct of terephthalic acid. Although this dye composition increased stability, significant degradation still occurred and satisfactory dyeing was not obtained. These poor results were especially prevalent when the dye composition was applied by spraying which exposes the largest liquid surface area to the atmosphere.

SUMMARY OF THE INVENTION

It is therefore an object of the present invention to provide a non-aqueous process for the dyeing of dyeable materials at an elevated temperature in which the dyestuff does not undergo significant degradation.

It is a further object to provide a non-aqueous dyeing process at an elevated temperature that allows for the recycling of the dye composition without significant degradation of the dyestuff.

It is also an object to provide a process for the non-aqueous dyeing of dyeable materials at an elevated temperature in which the various steps, such as preparation of the dye composition, preheating, dyeing, cooling, rinsing, and drying, are conducted in the same non-reactive environment.

Additional objects and advantages of the invention will be set forth in part in the description that follows and in part will be obvious from the description, or may be learned by practice of the invention. The objects and advantages of the invention may be realized and obtained by means of instrumentalities and combinations particularly pointed out in the appended claims.

To achieve these and other objectives, the present invention provides a non-aqueous process for the dyeing of a dyeable material at an elevated temperature, the improvement comprising the step of contacting a dyeable material with a dye composition at an elevated temperature in a non-reactive environment, the dye composition temperature and the time of contact between the dye composition and the dyeable material being sufficient to effectuate the dyeing of the dyeable material, the dye composition comprising a substantially non-aqueous solvent and a dyestuff.

The present invention further provides a non-aqueous process for the dyeing of a dyeable material at an elevated temperature comprising the steps of: preheating the dyeable material; contacting the preheated dyeable material with a dye composition at an elevated temperature in a non-reactive environment, the dye composition temperature and the time of contact between the dye composition and the dyeable material being sufficient to effectuate the dyeing of the dyeable material, the dye composition comprising a substantially non-aqueous solvent and a dyestuff, the non-reactive environment being selected from the group consisting of fluorocarbons and halogenated hydrocarbons; and cooling the dyed dyeable material.

The dye composition preferably utilizes a solvent having a boiling point greater than water. In a preferred embodiment, the solvent is at least one of an aromatic ester and a cycloaliphatic diester. The preferred fluorocarbon is 1,1,2-trichloro-1,2,2-trifluoroethane, which has the chemical formula $CCl_2FCClF_2$. The preferred halogenated hydrocarbon is 1,1,1,trichloroethane (methyl chloroform), which has the chemical formula $CH_3CCl_3$. The term dyestuff collectively refers to all of the individual dyestuffs that are present in the dye composition to obtain the desired coloration of the dyeable material.

The process of the present invention obviates the problem of dye composition degradation by providing and maintaining a nonreactive environment, such as a fluorocarbon or a halogenated hydrocarbon, during the time the dyeable material is being contacted with the dye composition. This non-reactive environment prevents the dye composition from undergoing degradation. As used herein, the term degradation refers to the loss of coloration or color strength of the dyestuff in the dye composition.

The process further allows the dyeing process to be conducted at an elevated temperature, since the solvent preferably has a boiling point greater than water. As a result of the elevated dyeing temperature, the dyeing process can be carried out in less time than with aqueous dyeing processes.

Since degradation of the dyestuff has been significantly reduced, the process permits the recycling of the dye composition without adversely affecting the quality of the dyed product. Environmental and economic benefits are provided, because the used composition is not discharged into the environment.

As used herein, the term dyeable material is defined as any material that is capable of being dyed. The dyeable material can be either a textile material or a non-textile material, such as plastic. When the dyeable material is a textile material, for example a garment such as a shirt, a skirt, or a pair of pants made from a synthetic material such as polyester, the present process also allows for the simultaneous shaping and setting of the dyeable material, while the material is being dyed. The shaping and setting of the garment provides creases, if desired, and smooths out any wrinkles.

The foregoing and other objects, features, and advantages of the present invention will be made more apparent from the following description of the preferred embodiments.

BRIEF DESCRIPTION OF THE DRAWINGS

The accompanying drawings which are incorporated in and constitutes a part of the specification, illustrate one embodiment of the invention and, together with the description, serve to explain the principles of the invention.

FIG. 15 is a top perspective view of a carrier and dye composition distribution head used in the present invention.

FIG. 16 is a front view of the carrier and dye composition distribution head shown in FIG. 15.

FIG. 17 is a schematic diagram of the means used to rotate the carousel unit of FIG. 1.

DESCRIPTION OF THE PREFERRED EMBODIMENT

Figure 1:
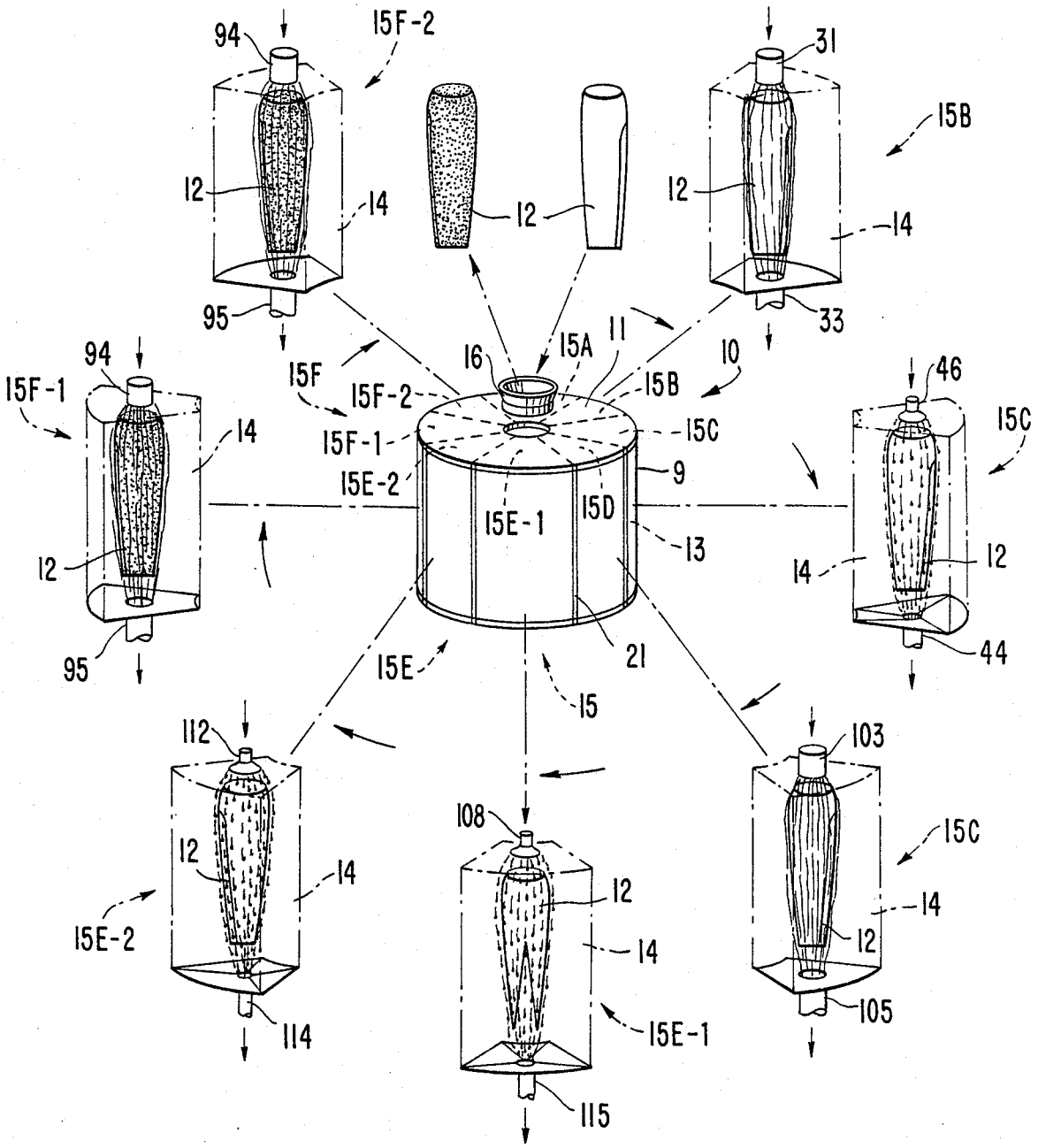
FIG. 1 is a schematic diagram depicting the apparatus of the present invention.

In a preferred embodiment of this invention, a non-aqueous process for the dyeing of a dyeable material at an elevated temperature is provided. In the process, a dyeable material is contacted with a dye composition at an elevated temperature in a non-reactive environment. The dye composition temperature and the time of contact between the dye composition and the dyeable material are sufficient to effectuate the dyeing of the dyeable material. As used herein, the dye composition comprises a substantially non-aqueous solvent, a dyestuff, and, if needed, one or more additives. Preferably, the solvent contains no water, but some water may be present.

In the present invention, the term non-reactive environment is defined as any composition that can be maintained as a stable gas at the dyeing temperature, without reacting with the dye composition or the dyeable material, and that will displace the air and, therefore, the oxygen surrounding the dyeable material and dye composition. Compounds that can be used as a non-reactive environment include fluorocarbons; halogenated hydrocarbons; inert gases such as argon, neon, and helium; low boiling alcohols and organic solvents; nitrogen; carbon dioxide; and combinations thereof. Fluorocarbons or halogenated hydrocarbons are the preferred compounds. The non-reactive environment preferably should have a boiling point below the temperature of the dyeing step but above the temperature of the rinse step. This permits use of the compound forming the environment as a gas in the dyeing step and a liquid in the rinse step.

Fluorocarbon solvents are relatively easy to maintain in a vapor state; fairly safe for human exposure; and unlikely to break down into acid components. Moreover, they can be easily separated from the dye composition by distillation. This permits the recycle of both components. An especially effective fluorocarbon is 1,1,2-trichloro-1,2,2-trifluoroethane, which has the chemical formula $CCl_2FCClF_2$ and is sold by E. I. Dupont de Nemours and Company under the trademark "Freon TF." Freon is a trademark of the E. I. DuPont de Nemours and Company for fluorocarbon solvents. Freon TF has a molecular weight of 187.39, a boiling point of 117.63° F., and a freezing point of −31° F. It is nonflammable and has a threshold limit value (T.L.V.) of 1000 ppm.

A preferred halogenated hydrocarbon is 1,1,1,trichloroethane (methyl chloroform), which has the chemical formula $CH_3CCl_3$, a molecular weight of 133.42, a boiling range of 162° F. to 190° F., and a freezing point of −58.0° F. It is nonflammable and has a threshold limit value (T.L.V.) of 350 ppm.

The solvent used in the dye composition preferably has a boiling point greater than water and can be one of the aromatic esters and the cycloaliphatic diesters disclosed in U.S. Pat. No. 4,293,305 in the name of Robert B. Wilson.

More specifically, the aromatic ester can be of the formula $ArCOOR_2$, $ArCOO\text{-}R_1\text{-}OOCAr$ or $(ArCOO)_z\text{-}R_3$, wherein $R_1$ is alkylene of 2–8 carbon atoms or polyoxyalkylene of the formula $—C_rH_{2r}(OC_rH_{2r})_s$, in which r is 2 or 3 and s is up to 15; $R_2$ is substituted or unsubstituted alkyl or alkenyl of 8–30 carbon atoms; $R_3$ is the residue of a polyhydric alcohol having z hydroxyl groups; Ar is mono- or bicyclic aryl of up to 15 carbon atoms and z is 3–6.

The cycloaliphatic diester can be of the formula:

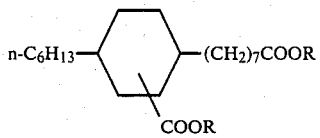

wherein R is substituted or unsubstituted straight or branched chain alkyl of 4–20 carbon atoms, polyoxyalkylene of the formula $R'(OC_xH_{2x})_n$ or phosphated polyoxyalkylene of the formula $$(HO)_2P(=O)(OC_xH_{2x})_nOC_xH_{2x}-$$

or a salt thereof, wherein $(C_xH_{2x}O)_n$ is $(C_2H_4O)_n$—, $(C_3H_6O)_n$—or $(C_2H_4O)_p$—, $(C_3H_6O)_q$—; R′ is H or ArCO; Ar is mono- or bicyclic aryl of up to 15 carbon atoms; x is 2 or 3; n is 2–22 and the sum of p+q is n.

Other solvents include glycerides, such as vegetable oils of which corn oil, peanut oil, and blends thereof are examples, and fatty acids.

The dyestuffs can be those commonly found in the art, such as disperse, vat, reactive, direct, acid, basic, sulfur, and pigment. The additives can be any of those known in the art, such as levelers, dye carriers, and organic finishing agents.

Figure 10:
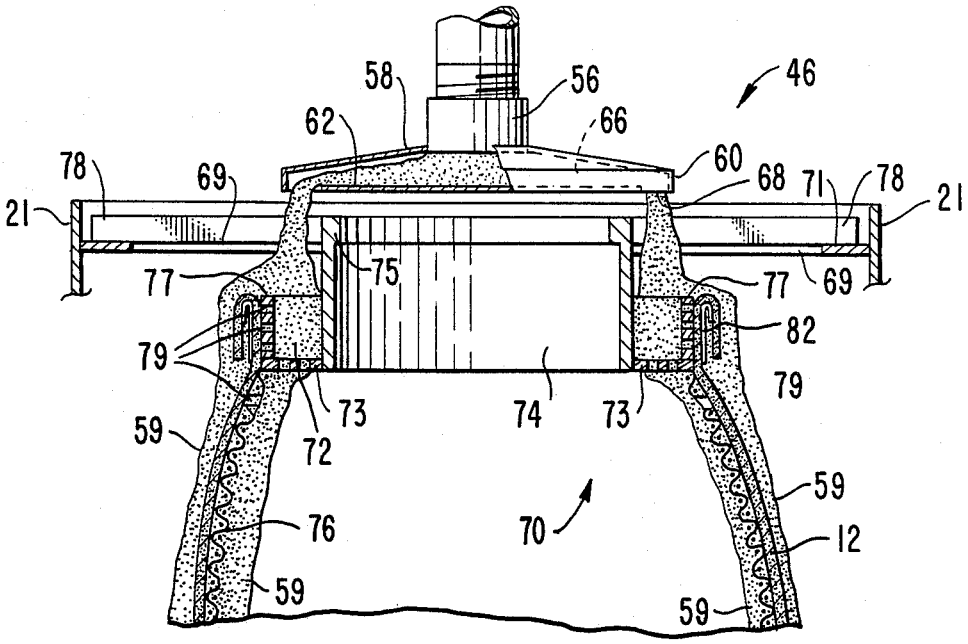
FIG. 10 is a schematic diagram showing the contacting of a dyeable material with a thin continuous film of the dye composition in the dyeing station of the apparatus in FIG. 1.

In one embodiment, as shown in FIG. 10, the dye composition is contacted with the dyeable material in a manner that a thin continuous film of the dye composition flows over the surfaces of the dyeable material to be dyed. Thus, the entire dyeable material is in contact with the dye composition throughout the dyeing process. The dyeable material is accordingly exposed to an environment which is substantially the same as in an immersion dyeing process. Indeed, since the film is in constant motion and flowing very rapidly, the dyeable material is continuously exposed to fresh dye composition. This dynamic condition cannot be easily achieved in an immersion bath. For this reason, this embodiment can be characterized as a microbath technique. The non-reactive environment surrounds the microbath to prevent the degradation of the dye composition.

The microbath technique is to be distinguished from previous processes that spray or shower the dye composition onto the dyeable material, or immerse the material into a dye bath. Spray or shower techniques apply the dye composition to the dyeable material in the form of droplets or fine discrete particles which expose the largest liquid surface area to the ambient atmosphere. As a result, the entire dyeable material is not in constant contact with the dye composition throughout the dyeing step. Moreover, since the droplets must pass through the surrounding ambient atmosphere before contacting the dyeable material, significant heat loss occurs. This makes it very difficult to maintain the dye composition at the appropriate temperature. Also, at elevated temperatures significant dye degradation occurs because of increased mixing with the ambient air.

In an immersion technique, the entire dyeable material is immersed in a large volume of the dye composition. Although the material is completely covered by the dye composition as in the microbath technique, a significantly larger quantity of dye composition is required that also must be heated and stored. Furthermore, the dye composition in the immersion process is not in constant and rapid motion; hence, the dyeable material is not continuously exposed to fresh dye composition.

The dyeing step is preferably conducted at atmospheric pressure. However, pressures above and below atmospheric pressure can also be used.

Prior to applying the dye composition to the dyeable material, the dye composition is heated to the desired elevated temperature. The heating of the dye composition is conducted in a non-reactive environment to reduce significantly the degradation of the dye composition. The temperature selected depends upon the dyeable material being dyed, the particular dye composition, and the desired contact time between the dye composition and the dyeable material. When the dyeable material is a synthetic material, such as a polyester fabric, the dye composition is heated to a temperature above the glass transition of the synthetic material, but below both the melting point of the synthetic material and the boiling point temperature of the dye composition.

One skilled in the art would select the particular dye composition depending upon the particular material being dyed. Usually, the dyeable material is first selected and then the particular dye composition and temperature range for the dyeing process are chosen.

Prior to the dyeing step, the dyeable material can be preheated to allow for more rapid dyeing. By preheating the dyeable material to a temperature approximately equivalent to the temperature of the heated dye composition, a more rapid and better quality of dyeing is achieved. Typically, when a synthetic material such as polyester is used, it is preheated to a temperature above the glass transition temperature of the synthetic material, but below its melting point and the boiling point of the dye composition.

Preferably, the preheating of the dyeable material is conducted in the same non-reactive environment used in the dyeing step. In one embodiment a gaseous fluorocarbon, such as Freon TF, is passed over the dyeable material. However, other methods of preheating the dyeable material can also be used.

After the dyeable material is dyed, the material is cooled to fix the dyestuff in the dyeable material. With a synthetic material, the cooling temperature is below the glass transition temperature. This also prevents the dyeable material from changing its shape, a factor that is particularly important if a garment is being treated.

Preferably, the cooling step is conducted in a non-reactive environment to prevent the degradation of the dye composition still in contact with the dyeable material. As a result, when the unabsorbed dye composition is removed from the dyeable material in a rinsing step, it can be reused. The cooling of the heated dyeable material can be achieved by passing fluorocarbon, such as Freon TF in its gaseous state, over the dyeable material.

After the cooling of the dyed dyeable material, the present process can also include the further steps of rinsing the cooled dyeable material with a rinse liquid to remove excess dye composition and of drying the rinsed material. The rinse step could be accomplished by flowing a non-reactive compound over the dyeable material. Preferably, the rinse liquid is the same chemical composition that is used as the non-reactive environment in the dyeing step, but different non-reactive compounds can also be used. This will prevent degradation of the dye composition and permit its continued use in the dyeing step. However, the dyeable material can also be rinsed and dried by other known techniques. The rinse temperature is below both the boiling point of the rinse composition and of the dye composition, as well as the melting temperature of the dyeable material.

In the drying step, the non-reactive environment is heated to vaporize any liquid and expel any gaseous composition remaining on the dyeable material. The amount of time needed for the rinsing and drying steps depends on various factors, such as the type of dyeable material, the dye composition solvent, and the temperature of the non-reactive environment used in each step.

The present process can be used in the non-aqueous dyeing, at an elevated temperature, of a variety of dyeable materials. The process is especially usable to dye textile materials, for example synthetic materials such as polyester. Examples of other synthetic materials include polyamides, polyurethanes, acrylics, halogenated polyolefins, polyolefins such as polypropylene, aramids such as Kevlar and Nomex which are trademarks of E. I. DuPont de Nemours & Co., and epoxy plastics. The process can also dye natural materials including cellulosic fibers, wool, and silk. Likewise, blends of materials such as polyester-cotton or polyester-wool may be dyed. Other synthetic and natural materials known in the art can also be used in the present process.

The textile material can be in any form, for example, fibers, yarns, fabrics, garments or garment components. The fabrics can be woven, nonwoven, knitted, tufted, or needle punched. Furthermore, entirely cut, sewn and shaped garments ready for wear, such as pants, skirts or shirts, can be dyed by the process. The textile materials to be dyed can also be fabric components that will ultimately be formed into a completed garments.

Following are examples of the present invention, which are intended to be merely exemplary.

EXAMPLE NO. 1

A dye composition was prepared containing 10 g/l of Navy Blue 2GLS manufactured by Mobay Chemical Corp. (C.I. Disperse Blue 79) in a terephthalic acid adduct of a diester as disclosed by Wilson in U.S. Pat. Nos. 4,293,305 and 4,394,126 and available from Crucible Chemical Co. under the commerical name of Cruester 1000 DTR.

One half of the dye composition (Dye Bath A) was heated to 185° C. in air and the second half (Dye Bath B) was heated to 185° C. under a non-reactive environment of gaseous 1,1,2-trichloro-1,2,2-trifluoroethane (Freon TF manufactured by E. I. DuPont de Nemours & Co.).

Textile material samples consisting of 100% polyester textured filament woven fabric, partially heat set and scoured to remove all processing additives and chemicals, were dyed at 185° C. with each of the dye compositions in their respective environments. The dye compositions were in contact with the dyeable materials for a period of 60 seconds. After dyeing, the samples were cooled, thoroughly rinsed with liquid Freon TF until no visible coloration of the rinse liquid and air dried.

The two dye compositions were then aged at 185° C. for a period of 4 hours. Ageing of Dye Bath A was carried out in air, while Dye Bath B was aged in a gaseous Freon TF environment.

After the ageing period, samples of the same dyeable material used for the initial dyeings were dyed in the aged dye compositions following the same dyeing procedure.

Color strength of the four dyed polyester dyeable materials was assessed by reflectance measurements in an ACS Color Control unit.

| Dye Composition | Dye Bath Treatment | % Color Strength |
|---|---|---|
| Dye Bath A | Initial (Air) | 100% |
| Dye Bath A | 4 hrs. ageing in air | 15% |
| Dye Bath B | Initial (Freon TF) | 100% |
| Dye Bath B | 4 hrs. ageing in Freon TF | 75% |

The above data clearly shows that the loss in color strength is significantly reduced when the dyeing process is carried out in a non-reactive environment, such as in gaseous 1,1,2-trichloro-1,2,2-trifluoroethane (Dyebath B), as compared to air (Dyebath A).

EXAMPLE NO. 2

Three dye compositions, approximately matching a red, a peony and a slate shade, were prepared by dissolving each dyestuff composite tabulated below in a terephthalic acid adduct of a diester as disclosed by Wilson in U.S. Pat. Nos. 4,293,305 and 4,394,126 and available from Crucible Chemical Co. under the commerical name of Cruester 1000 DTR.

| Dyestuff in grams/liter | Ref. Note | Red | Peony | Slate |
|---|---|---|---|---|
| Resolin Red F3BS | (1) | 14.21 | — | — |
| Eastman Yellow 6GLSW | (2) (3) | 1.69 | — | 1.58 |
| Resolin Blue FBL | (1) (3) | — | 0.08 | — |
| Resolin Yellow 5GL | (1) | — | 0.10 | — |
| Polyester Red YSL | (2) (3) | — | 15.74 | — |
| Polyester Navy Blue RDH | (2) | — | — | 14.02 |

Ref. Note:
(1) The Resolin dyestuff is manufactured by the Mobay Chemical Corp.
(2) The dyestuff is the press cake equivalent manufactured by Eastman Chemical Products, Inc.
(3) Eastman Yellow 6GLSW: C.I. Disperse Yellow 88
Resolin Blue FBL: C.I. Disperse Blue 56
Polyester Red YSL: C.I. Disperse Red 339

Two sets of dye compositions were prepared by mixing the dyestuff composite for each shade into the Cruester 1000 DTR. The first set was then heated to 185° C. in air with stirring. The second set was heated to 185° C. with stirring under a non-reactive environment of gaseous 1,1,2-trichloro-1,2,2-trifluoroethane (Feon TF manufactured by E. I. DuPont de Nemours & Co.).

Samples of 100% polyester textured filament woven fabric, partially heat set and scoured to removed all processing additives and chemicals, were dyed at 185° C. in ambient air for the set of dye compositions prepared by heating in air and under Freon TF for the set prepared by heating in a non-reactive environment. The dye compositions were in contact with the dyeable material samples for a period of 60 seconds. After dyeing, the samples were cooled in their respective environments, thoroughly rinsed with liquid Freon TF until no visual coloration of the rinse liquid, and then air dried.

The color strength of the dyed polyester dyeable materials was assessed by reflectance measurements in a ACS Color Control Unit. The percentile comparative color strengths are shown below:

| Shade | Dyeing Process Environment | |
|---|---|---|
| | Freon TF | Air |
| Red | 100% | 78% |
| Peony | 100% | 77% |
| Slate | 100% | 52% |

The tabulated data indicates that heating the dye composition in air was sufficient to reduce significantly the coloring strength of the dye compositions as compared to the same preparation and dyeing under a non-reactive environment.

EXAMPLE NO. 3

A dye composition was prepared by mixing 10 g of Polyester Navy Blue RDH, manufactured by the Eastman Chemical Products, Inc., in 1000 ml of a terephthalic acid adduct of a diester as disclosed by Wilson in U.S. Pat. Nos. 4,293,305 and 4,394,126 and available from Crucible Chemical Co. under the commercial name of Cruester 1000 DTR. One half of the dye composition (Dye Bath C) was heated to 185° C. in air and the other half (Dye Bath D) was heated to 185° C. under a non-reactive environment of gaseous 1,1,2-trichloro-1,2,2-trifluoroethane (Freon TF manufactured by E. I. DuPont de Nemours & Co.).

Samples of 100% polyester textured filament woven fabric, partially heat set and scoured to remove all processing additives and chemicals, were dyed at 185° C. with each dye composition in their respective environments. The dye compositions were in contact with the dyeable materials for a period of 30 seconds. After dyeing, the samples were cooled, thoroughly rinsed with liquid Freon TF until no visible coloration of the rinse liquid, and dried in air. Dye Bath C and Dye Bath D were then aged for 4 hours at 185° C. in, respectively, air and gaseous Freon TF environments.

Samples of the same dyeable material used for the initial dyeings were also dyed with the aged dye compositions following similar dyeing procedures.

The color strength of the dyed polyester samples was assessed by reflectance measurements in a ACS Color Control Unit. The reflectance of the sample dyed in the initial Dye Bath D under Freon TF was set at 100% and comparative percentiles for the other reflectance measurements were computed and are tabulated below:

| Dye Composition | Dye Bath Treatment | % Color Strength |
|---|---|---|
| Dye Bath C | Initial (Air) | 12.5 |
| Dye Bath C | 4 hrs. ageing in air | 3.5 |
| Dye Bath D | Initial (Freon TF) | 100 |
| Dye Bath D | 4 hrs. ageing in Freon TF | 26.5 |

Polyester Navy Blue RDH is an extremely sensitive dyestuff and the above data show the very significant loss of initial color strength and the total degradation after 4 hours ageing in air. Moreover, the actual blue color of the dyestuff was completely lost and the dyed dyeable material sample had a dirty straw shade.

EXAMPLE NO. 4

The preparation, dyeing, and ageing procedures in Example 3 were repeated utilizing, this time, a dye composition containing 10 g/l of Orange BRT manufactured by the Eastman Chemical Products, Inc., (C.I. Disperse Orange 145) in a terephthalic acid adduct of a diester as disclosed by Wilson in U.S. Pat. Nos. 4,293,305 and 4,394,126 and available from Crucible Chemical Co. under the commercial name of Cruester 1000 DTR.

The color strength of the four dyed polyester samples was assessed by reflectance measurements in a ACS Color Control Unit. The reflectance of the sample dyed in the initial dye composition prepared under Freon TF (Dye Bath D) was set at 100% and comparative percentiles for the other reflectance measurements were computed and are tabulated below:

| Dye Composition | Dye Bath Treatment | % Color Strength |
|---|---|---|
| Dye Bath C | Initial (Air) | 100 |
| Dye Bath C | 4 hrs. ageing in air | 49 |
| Dye Bath D | Initial (Freon TF) | 100 |
| Dye Bath D | 4 hrs. ageing in Freon TF | 100 |

The orange is a considerably more stable dyestuff than the Navy Blue used in Example No. 3. However, over one half of the color strength is lost after ageing the dye composition for 4 hours in air. Under a non-reactive environment, no degradation of the color strength was noted.

EXAMPLE NO. 5

A dye composition was prepared containing 1 g/l of C.I. Disperse Blue 6 in a diester as disclosed by Wilson in U.S. Pat. Nos. 4,293,305 and 4,394,126 and available from Crucible Chemical Co. under the commercial name of Cruester 1000 D.

A 1 ml aliquot of the dye composition was withdrawn and diluted to 100 mls with 1,1,2-trichloro-1,2,2-trifluoromethane (Freon TF manufactured by E. I. DuPont de Nemours & Co.). The diluted sample was analyzed in a Bausch & Lomb Spectronic 21. The transmission value was measured at 620 nanometers (nm) and was set as the base value (100%). All the other transmission measurements in this example were compared to this original base strength of 1 g/l.

The dye composition was then divided into three parts and aged at 185° C. for 12 hours under the following conditions:

Dye Bath E: Ageing was carried out in air.

Dye Bath F: A stream of air was bubbled through the dye composition during the entire ageing period.

Dye Bath G: The dye composition was aged in a Freon TF environment.

At specific time intervals, 1 ml aliquots were removed from the Dye Baths (E, F, and G), diluted to 100 mls with Freon TF, and the transmission was measured at 620 nm. with a Bausch & Lomb Spectronic 21. The transmission values were then compared to the original, and a percentile was computed. The following results were obtained.

| Ageing (Hours) | % Color Strength | | |
|---|---|---|---|
| | Dye Bath E AIR | Dye Bath F AIR BUBBLING | Dye Bath G FREON TF |
| Original | 100 | 100 | 100 |
| 0.5 | 96.0 | 93.0 | 100 |
| 1.0 | — | 83 | 100 |
| 1.5 | 90.5 | 75.5 | 100 |
| 2.0 | — | 69.5 | 100 |
| 2.5 | — | 66.5 | 100 |
| 4.5 | — | 62.0 | 100 |
| 6.0 | — | 60.0 | 100 |
| 8.0 | — | 58.0 | 100 |
| 9.0 | 65.0 | 55.0 | 100 |

-continued

| | % Color Strength | | |
|---|---|---|---|
| Ageing (Hours) | Dye Bath E AIR | Dye Bath F AIR BUBBLING | Dye Bath G FREON TF |
| 12.0 | 59.0 | 51.0 | 100 |

The above data show the effect of air on the high temperature ageing characteristics of the dye composition. More specifically, the rapid degradation of Dye Bath F, when air is bubbled through he liquid, is indicative of the results that could be obtained in a process in which the dye composition is sprayed or showered over the dyeable material. The effect of maintaining the dye composition in a non-reactive environment is apparent. No change occurred even after ageing for 12 hours at 185° C.

Reference is now made in detail to the present preferred embodiment, as illustrated in FIGS. 1–17. In accordance with the invention, an apparatus 10, for the dyeing of shaped dyeable materials comprises means for surrounding a shaped dyeable material with a non-reactive environment in a treatment chamber 14 and means for flowing a thin continuous film of the dye composition over the surfaces of a dyeable material at an elevated temperature in a non-reactive environment. The apparatus 10 is especially useful in dyeing dyeable materials in the form of a shaped article, such as a garment.

The apparatus 10 also can comprise: means for transporting the shaped dyeable material within the apparatus in a treatment chamber 14; means for preheating the shaped dyeable material prior to flowing the thin continuous film over the dyeable material; and means for cooling the dyed shaped dyeable material. The apparatus can further include rinse means for rinsing the dyed shaped dyeable material and drying means for drying the dyed shaped dyeable material.

Figure 2:
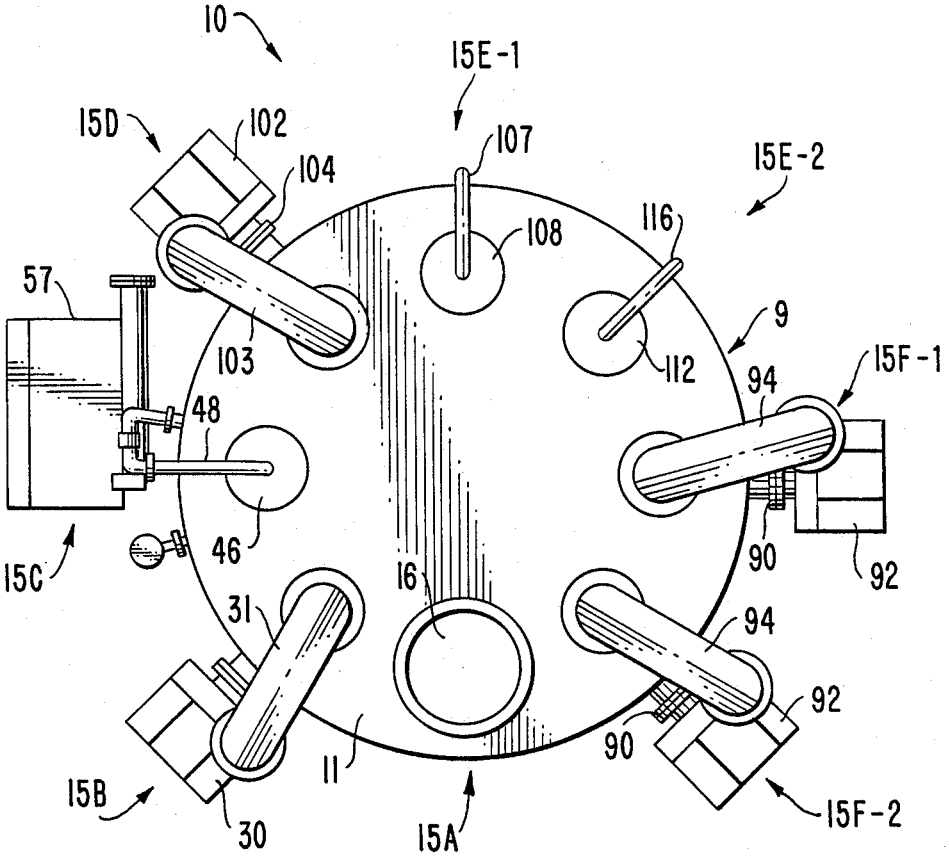
FIG. 2 is a plan view of the apparatus of FIG. 1.
Figure 3:
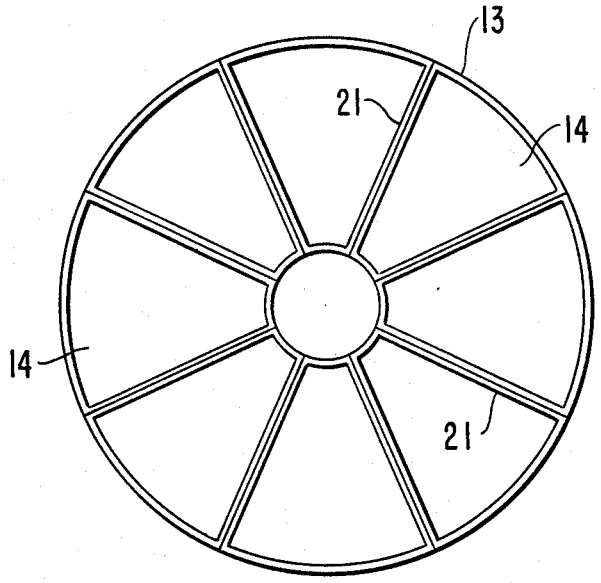
FIG. 3 is a plan view of the interior of the apparatus of FIG. 1 slowing a plurality of treatment chambers.

As shown in FIGS. 1 to 3, the apparatus includes a stationary cylindrical vessel 9 with a vertical axis around which is rotated a carousel unit 13, having a plurality of treatment chambers 14 for supporting and transporting simultaneously several shaped dyeable materials 12 from work station 15 to work station 15.

More particularly, the carousel unit 13 has a plurality of treatment chambers 14, each of which contains a shaped dyeable material 12 that is to be treated in the apparatus 10. The shaped dyeable material 12, contained in each treatment chamber 14, is moved from one work station to another as the carousel unit 13 rotates. A different treatment, such as loading, preheating, dyeing, cooling, rinsing, drying, and unloading is performed on the shaped dyeable material 12 at each station 15.

As shown in FIG. 1, the work stations 15 include a loading and unloading station 15A, a preheating station 15B, a dyeing station 15C, a cooling station 15D, a rinsing station 15E, and a drying station 15F. In the loading and unloading station 15A, the shaped dyeable material 12 mounted on a carrier 70 (FIG. 4) is either loaded or unloaded from the treatment chamber 14, depending upon whether the treatment process is beginning or ending.

The chamber 14 has a port 16, through which the shaped dyeable material 12 is loaded and unloaded. Preferably, the port 16 is in the top cover plate 11 of the apparatus 10, but it may be located elsewhere in the apparatus depending upon the compound used for the non-reactive environment. With some compounds, the port 16 may be sealed to render the apparatus 10 airtight. Preferably, if the compound used as the non-reactive environment is heavier than air, the port 16 can be open and located in the top cover plate 11, since the non-reactive compound displaces the ambient air from the apparatus 10.

Once the first shaped dyeable material 12 to be process is positioned on the carrier 70 and then loaded into one of the chambers 14, the carousel unit 13 is rotated so that the newly loaded chamber 14 is in the preheating station 15B. (FIGS. 5 and 6) In the preheating station 15B, the shaped dyeable material is heated to a temperature approximately equal to that of the dye composition to be applied in the dyeing station 15C. As the carousel unit 13 rotates, the next empty chambers 14 is then positioned in the loading and unloading station 15A so that another shaped dyeable material can be loaded into the empty chamber 14.

After a predetermined time period, the carousel unit 13 is rotated and the preheated shaped dyeable material 12 is positioned in the dyeing station 15C. In the dyeing station 15C, the dye composition is applied to the shaped dyeable material 12. The predetermined time period depends upon the time necessary to effectuate the desired dyeing of the shaped dyeable material 12 in the dyeing station 15C. During the time needed to dye the shaped dyeable material 12, unloading and loading of the chamber 14, under the loading and unloading station 15A, takes place. The predetermined time period for rotating the carousel unit 13 is governed by the dyeing time; therefore, the shaped dyeable material 12 in each chamber 14 remains at each work stations 15 the same amount of time as determined by the dyeing cycle.

After the shaped dyeable material 12 in the dyeing work station 15C is dyed to the desired coloration and the carousel unit 13 is again rotated so that the dyed shaped dyeable material is positioned in the cooling station 15D. The shaped dyeable material 12 is then cooled to a temperature sufficient to fix the dyestuff in the shaped dyeable material and to prevent the shaped dyeable material from changing its shape.

After sufficient cooling, the carousel unit 13 is then rotated to place the cooled shaped dyeable material 12 in rinsing stations 15E. (FIG. 12) The used, but non-absorbed, excess dye composition is rinsed from the shaped dyeable material and recycled for use in the dyeing station 15C.

Once the shaped dyeable material 12 is rinsed, the carousel 13 is rotated so that the dyed shaped dyeable material is positioned in the drying station 15F. The shaped dyeable material is heated to vaporize any excess liquid. After drying, the shaped dyeable material 12 on the carrier 70 is unloaded from the chamber 14 through port 16 in the unloading station 15A.

As shown in FIG. 3, the plurality of treatment chambers 14 that form the carousel unit 13 are separated from each other by walls 21. The walls 21 can be constructed to seal each chamber 14 from the adjacent chamber to prevent the non-reactive environment in one chamber 14 from leaking into the other chamber 14. Preferably, the same non-reactive compound and environment is used in all of the chambers 14 so that such a tight seal between the chambers 14 need not be maintained by the walls 21.

The carousel unit 13 allows all of the stations 15 to treat simultaneously a number of shaped dyeable material 12 that are positioned on a plurality of carriers 70 within a plurality of chambers 14. Consequently, shaped dyeable material is being dyed, while others are simultaneously being unloaded, loaded, preheated, cooled, rinsed, and dried. Usually, the number of chambers 14 forming the carousel unit 13 corresponds to the number of work stations 15 so that a chamber 14 is positioned in each work station 15 every time the carousel unit 13 rotates.

As embodied herein, the means for transporting the shaped dyeable material 12 within the apparatus 10 in the chamber 14 between the various stations 15 includes the carousel unit 13 with the garment carriers 70 and a means for rotating the carousel unit 13. As embodied herein, the rotating means includes a motor and gear reducer 18 for rotating the carousel unit 13. A carousel position switch 20 determines the movement of the carousel unit 13. However, other known means for rotating the carousel unit 13 among the stations 15 can also be used.

As the chamber 14 rotates among the various work stations, a non-reactive environment is maintained around the shaped dyeable material 12 in the chamber 14. This prevents the degradation of the dyestuff and as a result the dye composition can be recycled and reused repeatedly for multiple dyeings. Preferably, the same non-reactive environment is present in the chamber 14 at all of the stations 15A to 15F to preserve the integrity of the nonreactive environment within the stationary cylindrical vessel 9.

Figure 4:
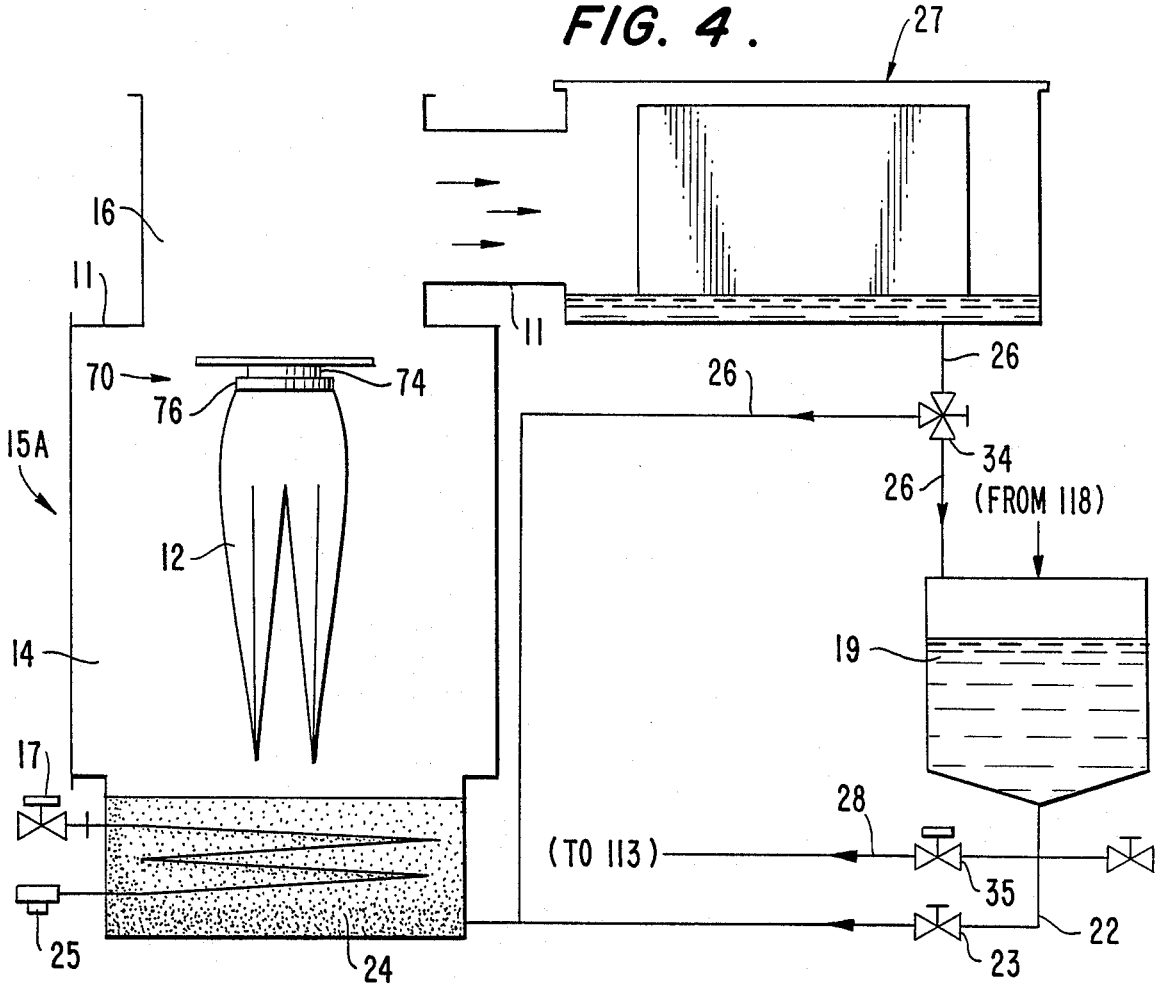
FIG. 4 is a more detailed schematic diagram of the loading and unloading work station of FIG. 1.

As embodied herein, the means for surrounding the shaped dyeable material 12 with a non-reactive environment in the treatment chamber 14 includes a gas vapor generator 24 for producing the non-reactive environment. Preferably, as shown in FIG. 4, the vapor generator 24 is stationary and located in the loading station 15A below the chamber 14.

The vapor generator 24 vaporizes the compound that is to be used as the non-reactive environment. The compound is fed into the vapor generator 24 from a tank 19 through a feed line 22. A valve 23 controls the flow of the feed. A steam source 17 with a condensate trap 25 is used as a heating source for the vapor generator 24.

As the generator 24 fills the chamber 14 with the compound of the non-reactive environment, some of the non-reactive compound escapes through the port 16 and is collected by a condenser 27 positioned on the top cover plate 11 of the apparatus 10. The condenser 27 condenses the collected compound to a liquid and returns it through conduit 26 to either the tank 19 or the vapor generator 24. A valve 34 controls the flow in the conduit 26.

The condensed compound can also be supplied to the rinse station 15E for use as a rinse liquid through conduit 28 controlled by valve 35, if the rinse station 15E uses the same nonreactive compound for rinsing as in the vapor generator 24. Similarly, reclaimed rinse liquid can be recycled to the tank 19 from a distillation unit 118 that receives its feed from the rinsing station 15E, as more fully described below.

Preferably, the chambers 14 are maintained at a temperature above the condensation temperature of the compound forming the non-reactive environment. Once the non-reactive environment is established in all of the chambers 14, the carousel unit 13 is rotated continuously among the various work stations 15, without the need of reestablishing a non-reactive environment in the chambers 14 each time.

Figure 5:
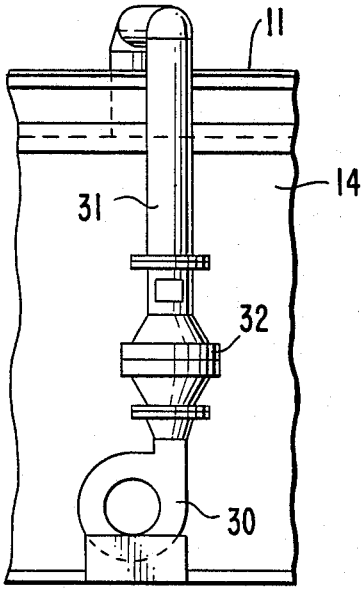
FIG. 5 is a front view of the preheating and drying work stations of FIG. 1.
Figure 6:
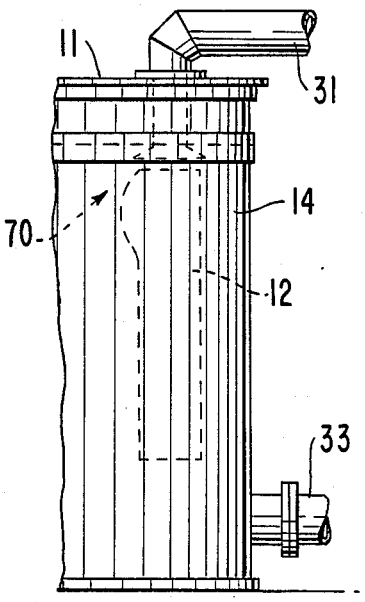
FIG. 6 is a side view of the preheating and drying work stations shown in FIG. 5.

In the preheating work station 15B shown in FIGS. 5 and 6, the means for preheating the shaped dyeable material 12, prior to flowing the thin continuous film of the dye composition over the shaped dyeable material 12, includes gas blower means for circulating a gas forming the non-reactive environment around the shaped dyeable material·12 and a heating unit 32 for heating the circulating gas. As embodied herein, the gas blower means includes a gas blower 30 and a conduit 31 leading the gas from the gas blower 30 into the chamber 14. The gas exits from the chamber 14 through a return outlet 33 to the blower 30 and the heating unit 32.

The heating unit 32 preferably contains one or more heating coils, as well as various temperature controls and dampers. The heating coils can have a steam source to heat the coils. Preferably, the gas blown on the shaped dyeable material is the compound, as defined above, that provides the non-reactive environment.

Figure 11:
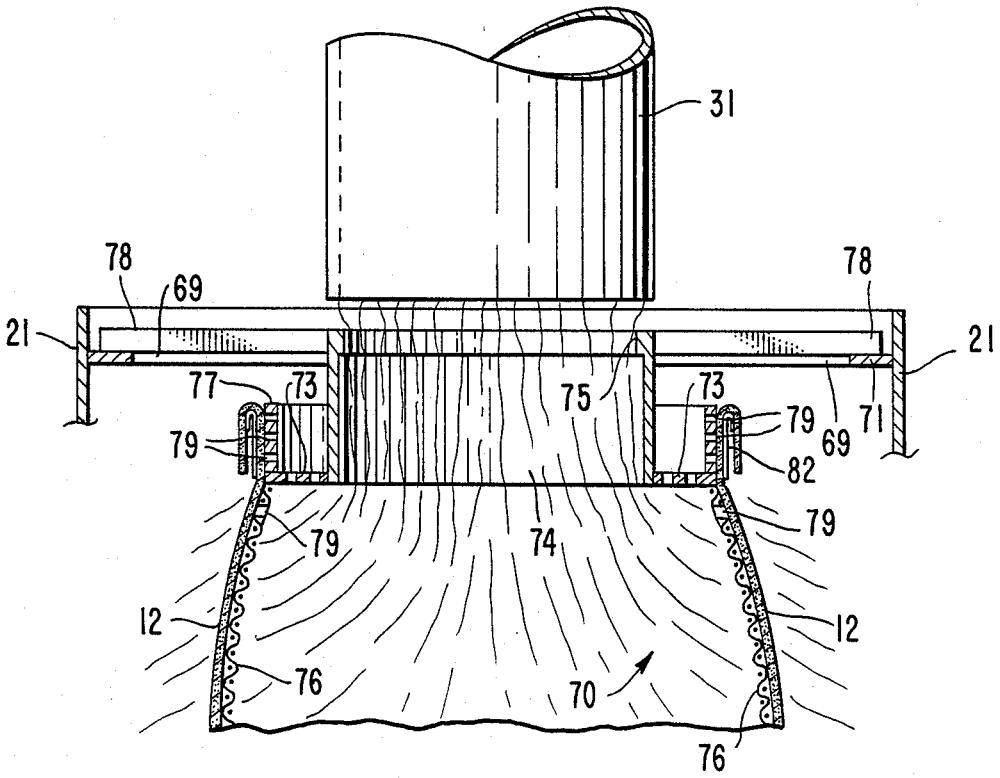
FIG. 11 is a schematic diagram showing the passage of the non-reactive environment gas through the dyeable material in any one of the preheating, cooling, and drying stations.

As shown in FIG. 11, in the preheating station 15B, the conduit 31 is positioned above the shaped dyeable material 12 in the chamber 14 to allow the heated gas to flow onto the shaped dyeable material 12 on the carrier 70. This positioning provides an effective and efficient heating of the garment 12.

Figure 7:
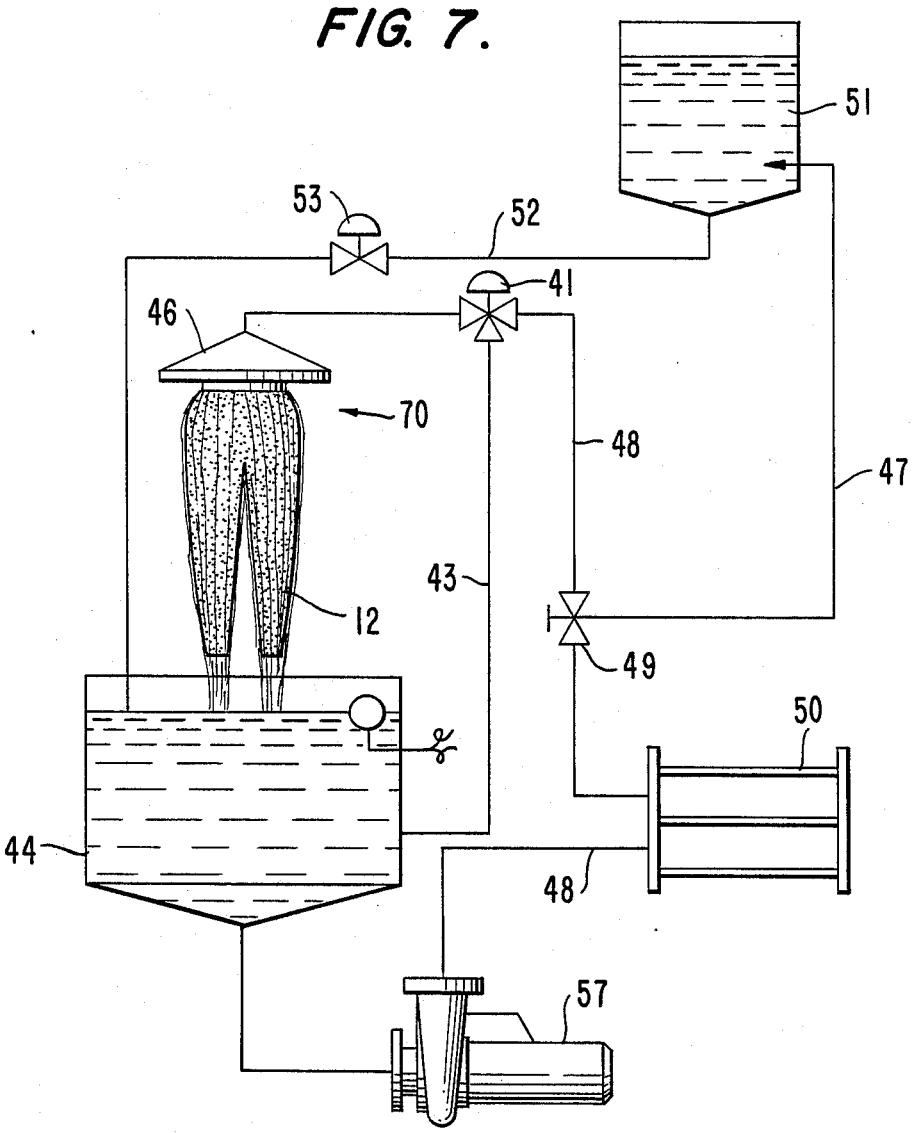
FIG. 7 is a more detailed schematic diagram of the dyeing work station of FIG. 1.
Figure 8:
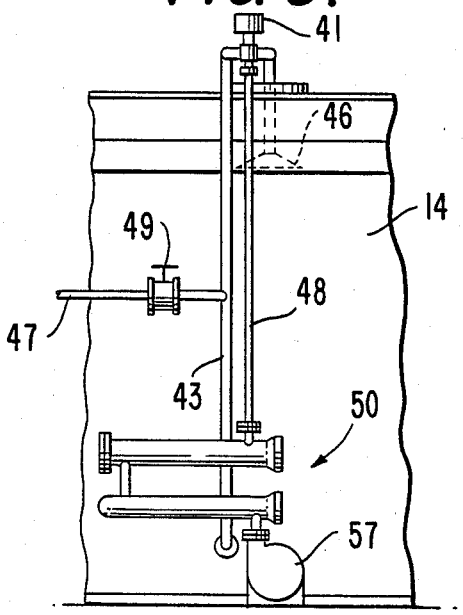
FIG. 8 is a front view of the dyeing work station of FIG. 1.
Figure 9:
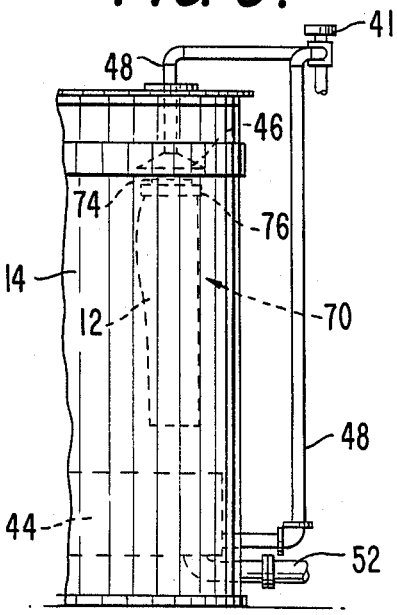
FIG. 9 is a side view of the dyeing work station shown in FIG. 8.

After the dyed material is preheated, the chamber 14 is rotated to the dyeing work station 15C shown in FIGS. 7–9. The means for flowing a thin continuous film over the shaped dyeable material includes an applicator head 46 for flowing a continuous thin film of the dye composition over the surfaces of the shaped dyeable material 12; and means for supplying the dye composition to the applicator head 46, such as a pump 57 for pumping the dye composition from a main tank 44 through a conduit 48 to a heating unit 50. The heating unit 50 heats the dye composition prior to supplying the dye composition to the applicator head 46.

When a shaped dyeable material 12 is not in the chamber 14, a diverter valve 41 prevents the flow of the dye composition to the applicator head 46. Rather, the dye composition is returned to the main tank 44 through a bypass line 43. This allows the dye composition to be maintained at the dyeing temperature by continued circulation and heating while the carousel unit 13 rotates.

The main tank 44 is located in the dyeing station 15C below the carousel unit 13. The main tank 44 can be relatively small, such as 5 gallons, in comparison to previous apparatus, due to the efficiency of the present dyeing process. The main tank 44 is maintained in a non-reactive environment to prevent dye degradation.

A reservoir tank 51 contains a reserve supply of dye composition for use as the supply of the dye composition in the main tank 44 diminishes. The dye composition from the reservoir tank 51 is fed into the main tank 44 through a conduit 52 controlled by valve 53. A conduit 47 can also feed heated dye composition through the heating unit 50 to the reservoir tank 51 in which the dye composition is stored until it is needed. A valve 49 diverts the flow between the conduit 48 and the conduit 47. As shown in FIGS. 7 and 10, the applicator head 46 is preferably positioned directly above the shaped dyeable material 12. The applicator head 46 applies the dye composition in a manner that a thin continuous film 59 of the dye composition flows over the all the surfaces of the shaped dyeable material 12, as shown in FIG. 10.

Figure 13:
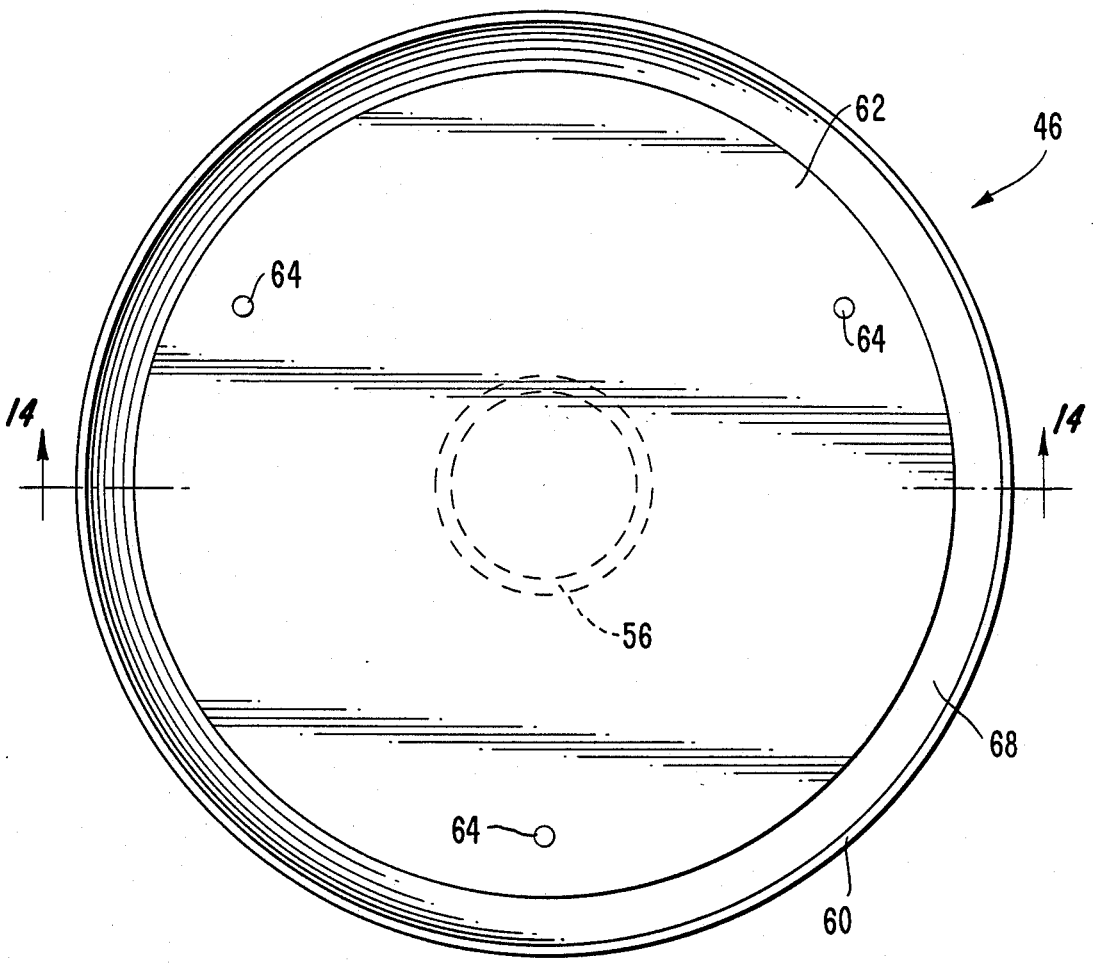
FIG. 13 is a plan view of an applicator head used in the assembly shown in FIGS. 7, 8, and 12.
Figure 14:
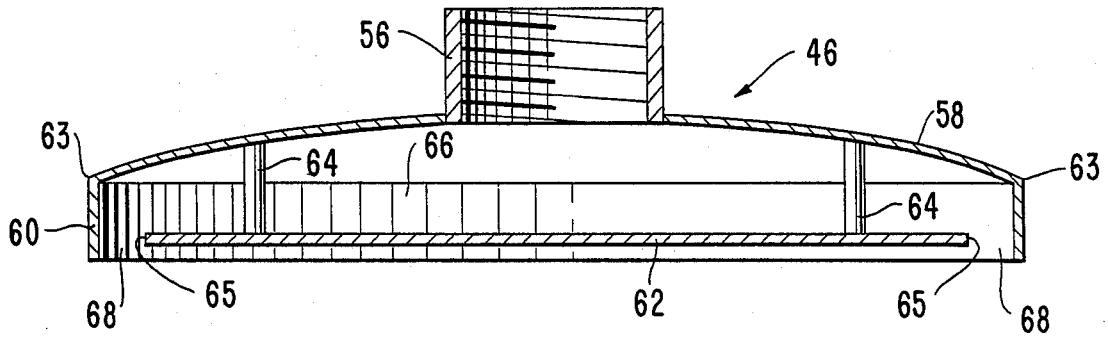
FIG. 14 is a cross section of the applicator head in FIG. 13 taken along line 14—14 thereof.

To provide the continuous thin film 59 of the microbath, the applicator head 46, as shown in FIGS. 13 and 14, includes an upper horizontally extending circuit retaining wall 58 having a circumferential ring 60 depending from the outer periphery 63 of the upper wall 58; and a lower horizontal wall 62 connected to the upper wall 58. The periphery 65 of the lower wall 62 is spaced inwardly from the circumferential ring 60 to define an annular downwardly facing discharge opening 68 for the discharge of the dye composition. A dispersion plenum 66 is formed between the upper wall 58 and the lower wall 62 for dispersing the dye composition from a coupling 56, through the plenum 66, and to the discharge opening 68.

To achieve the proper flow, the diameter of the lower wall 62 corresponds to the diameter of an inner frame 74 of the carrier 70 (FIG. 10).

As shown in FIGS. 7 and 10, the applicator head 46 is positioned directly above the carrier 70, when the chamber 14 is in the dyeing work station 15C. Such a positioning permits the dye composition to flow out of the applicator head 46, through the discharge opening 68, and into a circumferential inlet 72 of the carrier 70. The speed of the dye flow depends upon the dye composition, the material being dyed, the shape of the carrier 70 on which the material is positioned, and the compound used as the non-reactive environment.

As shown in FIGS. 10, 15 and 16, the carrier 70, preferably, has an inner frame 74 with an outwardly extending bottom wall 73 and an outer frame and support 76 connected to the bottom wall 73 to form a trough configuration. The inner frame 74 and the outer frame 76 together define a circumferential inlet 72 that lies horizontally above the bottom wall 73. The shaped dyeable material 12, such as a part of pants, a skirt, or a shirt, is fitted onto the outer frame and support 76 of the carrier 70.

Preferably, the outer frame 76 is made of a porous material such as woven wire screen that allows the dye composition to flow over and through to contact all sides of the dyeable material 12. The outer frame 76 is constructed to impart a smooth, dimensional shape to the desired areas of the dyeable material 12. In the particular case where the dyeable material 12 is a pair of pants, the carrier 70 includes flat blades 150 extending downwardly from the outer frame 76 (FIG. 16). The blades 150 are designed to impart creases to the leg portions of the pair of pants, and to maintain the surface of the dyeable material 12 in a smooth and unwrinkled condition during processing. The flat blades 150 may, if desired, be perforated to allow the dye composition to flow over and through or could be two narrow bands with appropriate spacing and supports coinciding with the edges of the blades 150.

During the dyeing process, the dye composition flows from the applicator head 46 into the circumferential inlet 72 of the carrier 70. Some of the dye composition then flows over the top rim 77 of the outer frame 76 onto the outside portion of shaped dyeable material 12. Some of the dye composition also flows out through holes 79 (FIG. 10) in the sieve like material of the outer frame 76 to contact the underside of the shaped dyeable material 12 held on the outer frame 76. In this manner, both sides of the shaped dyeable material 12 on the outer frame 76 are contacted by the continuous thin film 59 of the dye composition, in accordance with the microbath technique.

The carrier 70 is held in proper position within the chamber 14, as the carousel unit 13 rotates, by attaching a top lip 75 of the carrier 70 within a ring 69 formed by a flange 71 on each wall 21 of each chamber 14, as shown in FIGS. 10 and 11. Each carrier 70 has bars 78, as shown in FIGS. 10 and 11, that coact with the ring 69 to hold the shaped dyeable material 12 on each carrier 70 in proper position for treatment by the work stations 15.

The outer frame 76 can also include a clip 82, along the rim 77 of the outer frame 76, to hold the shaped dyeable material 12 in place on the outer frame 76. The outer frame 76 can be constructed in a number of separate pieces to form the shaped dyeable material 12, placed on the carrier 70, into the desired shape. The size and shape of the outer frame 76 generally corresponds to the size and shape of the shaped dyeable material 12 that is to be positioned on the outer frame 76. For example, if the shaped dyeable material 12 is a pair of pants, the outer frame 76 can be constructed to provide to the pants the final desired shape.

After the dye composition has been applied to the shaped dyeable material 12, the dyed shaped dyeable material in the chamber 14 is rotated to the cooling work station 15D. As embodied herein, the cooling means includes gas blower means for circulating a gas around the shaped dyeable material 12 and a cooling unit 104 for cooling the gas circulating around the dyed shaped dyeable material. As embodied herein and shown in FIG. 2, the gas blower means includes a gas blower 102 and a blower conduit 103 leading the cool gas from the gas blower 102 into the chamber 14. The gas exits from the chamber 14 through cooling exhaust outlet 105.

The cooling unit 104 preferably contains one or more cooling coils as well as various temperature controls and dampers. The cooling coils can have a water source to cool the coils. Preferably, the cool gas blown on the dyed shaped dyeable material is one of the above identified compounds that provides a non-reactive environment. The cooling station 15D is constructed similar to the preheating station 15B shown in FIGS. 5, 6, and 11.

Figure 12:
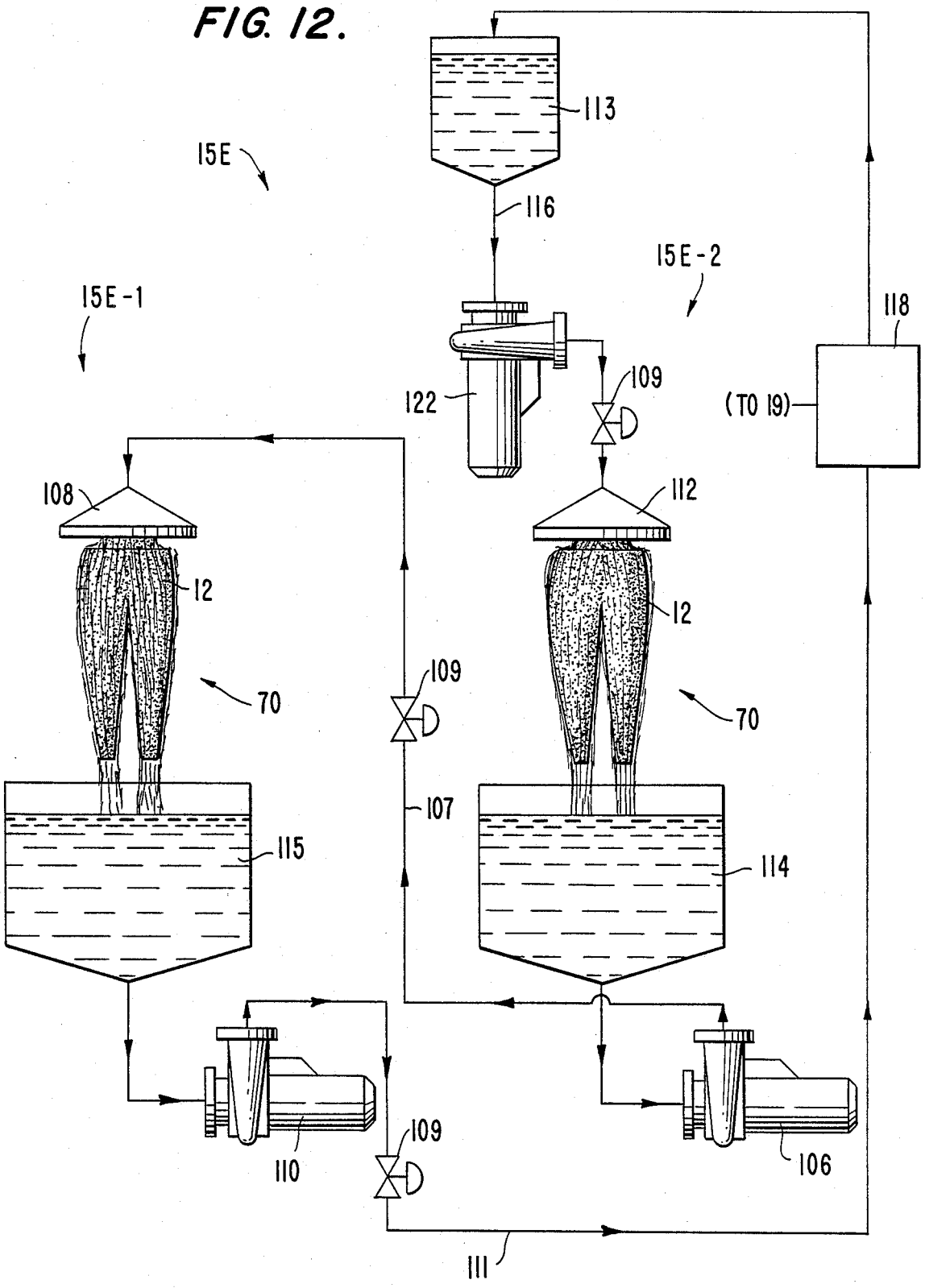
FIG. 12 is a more detailed schematic diagram of the rinsing work station of FIG. 1.

After the shaped dyeable material is cooled, the chamber 14 is rotated to the rinsing work station 15E shown in FIG. 12. Preferably, as shown in FIG. 12, two rinsing stations 15E-1 and 15E-2 having individual applicator heads 108 and 112, are used to apply a rinse liquid to the dyed shaped dyeable material. Fresh rinse liquid from a main tank 113 rinses shaped dyeable materials in rinse stations 15E-2 that have already been rinsed by the first rinse station 15E-1. The initial rinse of the freshly dyed and cooled, but unrinsed, shaped dyeable material 12 is carried out in rinse station 15E-1 that receives its rinse liquid from the downstream rinse station 15E-2. A pump 106 pumps the rinse liquid from a collection tank 114 through conduit 107 to the applicator head 108.

Consequently, recycled rinse liquid is used to rinse initially the shaped dyeable material 12 in rinse station 15E-1 while fresh rinse liquid is applied to the the once rinsed shaped dyeable material 12 in rinse station 15E-2. This countercurrent rinse process permits the use of the cleaner or fresher rinse solvent on the shaped dyeable material 12 to remove completely the excess dye composition after it has already been rinsed once. The rinse solvent used in the first rinse station 15E-1, consequently, is very dirty and it is collected in a tank 115, prior to being pumped by pump 110 through a conduit 111 to the distillation unit 118. Various valves 109 control the rinse liquid flow between the various components of the rinse stations.

Only one rinsing station, however, is necessary for the operation of the apparatus 10. As embodied herein, the rinsing means includes the applicator head 112 flowing a continuous thin film of a rinse liquid over the surfaces of the dyed shaped dyeable material 12; a means for supplying the rinse liquid, such as a pump 122 to the applicator 112; and means for recycling the rinse liquid applied over the dyed shaped dyeable material 12. The rinse liquid is preferably one of the above identified compounds that provides a non-reactive environment.

As embodied herein, the recycling means includes a distillation unit 118 (FIG. 12) to separate the rinse liquid from the dye composition solvent; the collection tank 114 positioned beneath the chamber 14; and one or more conduits 116 for transporting the rinse liquid between the main tank 113 and the applicator head 112.

The applicator head 112, used to apply a continuous flow of the rinse liquid over the dyed shaped dyeable material 12 in the rinsing work stations 15E, is similar to the applicator head 46, used to apply the dye composition to the undyed shaped dyeable material 12 in the dyeing work station 15C. The applicator head 112 is similarly positioned over the shaped dyeable material 12 on the carrier 70 so that a thin continuous film of the rinse liquid flows over all the surfaces of the shaped dyeable material 12 to form a microbath of the rinse liquid.

After the shaped dyeable material is rinsed, it is rotated to drying work station 15F as shown in FIGS. 1 and 2. As embodied herein, the drying means includes a gas blower means for circulating a gas around the dyed shaped dyeable material 12 and a heating unit 90 for heating the gas circulating around the dyed shaped dyeable material. As embodied herein, the gas blower means includes a gas blower 92, similar to the blower 30 of FIGS. 5 and 6 that is used to preheat the shaped dyeable material, and a blower conduit 94 leading the hot gas from the gas blower 92 into the chamber 14. The hot gas exits from the chamber 14 through the outlet 95.

The drying gas, preferably, is one of the above-described compounds that provide a non-reactive environment. Two separate drying stations 15F can be used in succession to dry effectively the shaped dyeable material. The drying station 15F is constructed similar to the preheating station 15B shown in FIGS. 5, 6, and 11.

The heating unit 90 preferably contains one or more heating coils, as well as various temperature controls and dampers. The heating coils can have a steam source to heat the coils.

After the shaped dyeable material 12 is dried, the chamber 14 is rotated to the unloading station 15A. The dyed and dried shaped dyeable material is removed from the chamber 14 through port 16.

Other embodiments of the invention will be apparent to one skilled in the art from a consideration of the specification or the practice of the invention disclosed herein. It is intended that the specification and examples be considered as exemplary only with the true scope and spirit of the invention being indicated by the claims.

What is claimed is:

1. In a non-aqueous process for the dyeing of a dyeable material, the improvement comprising the steps of (a) contacting a dyeable material with a dye composition in a non-reactive, substantially oxygen-free atmosphere, the dye composition temperature and the time of contact between the dye composition and the dyeable material being sufficient to effectuate the dyeing of the dyeable material with the dye composition being at a temperature equal to or greater than the temperature at which dye degradation occurs in an oxygen containing atmosphere, the dye composition comprising a substantially non-aqueous solvent having a boiling point of at least 100° C. and a dyestuff soluable in the solvent, the solvent being selected from the group consisting of aromatic esters, cycloaliphatic diesters, and triglycerides;

(b) removing the dye composition from contact with the dyeable material; and (c) recycling the dye composition removed in step (b) to contact the dyeable material in step (a).

2. The process as in claim 1, wherein the non-reactive atmosphere is selected from the group consisting of fluorocarbons, halogenated hydrocarbons, inert gases, low boiling alcohols, organic solvents, nitrogen, carbon dioxide, and combinations thereof.

3. The process as in claim 1, wherein the non-reactive atmosphere is selected from the group consisting of fluorocarbons and halogenated hydrocarbons.

4. The process as in claim 3, wherein the fluorocarbon is 1,1,2-trichloro-1,2,2-trifluoroethane.

5. The process as in claim 3, wherein the halogenated hydrocarbon is 1,1,1,trichloroethane.

6. The process as in claim 1, further comprising the step of preheating the dyeable material prior to contacting the dyeable material with the dye composition.

7. The process as in claim 6, wherein the dyeable material is preheated in a non-reactive, substantially oxygen-free atmosphere.

8. The process as in claim 7, wherein the non-reactive atmosphere is selected from the group consisting of fluorocrbons, halogenated hydrocarbons, inert gases, low boiling alcohols, organic solvents, nitrogen, carbon dioxide, and combinations thereof.

9. The process as in claim 1, further comprising the step of cooling the dyeable material after contacting the dyeable material with the dye composition.

10. The process as in claim 9, wherein the dyeable material is cooled in a non-reactive substantially oxygen-free atmosphere.

11. The process as in claim 10, wherein the non-reactive atmosphere is selected from the group consisting of fluorocarbons, halogenated hydrocarbons, inert gases, low boiling alcohols, nitrogen, carbon dioxide, and combinations thereof.

12. The process as in claim 1, wherein the aromatic ester is of the formula: $ArCOOR_2$, $ArCOO\text{-}R_1$ —OO-CAr or $(ArCOO)_z\text{-}R_3$, wherein R1 is alkylene of 2–8 carbon atoms of polyoxyalkylene of the formula $—C_rH_{2r}(OC_rH_{2r})_s$, in which r is 2 or 3 and s is up to 15; $R_2$ is substituted or unsubstituted alkyl or alkenyl of 8–30 carbon atoms; $R_3$ is the residue of a polyhydric alcohol having z hydroxyl groups; Ar is mono- or bicyclic aryl of up to 15 carbon atom and z is 3–6.

13. The process as in claim 1, wherein the cycloaliphatic diester is of the formula:

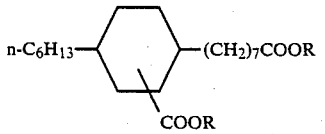

wherein R is substituted or unsubstituted straight or branched chain alkyl of 4–20 carbon atoms, polyoalkylene of the formula $R'(OC_xH_{2x})_n$ or phosphated polyoxyalkylene of the formula $(HO)_2P(=O)(OC_xH_{2x})_nOC_xH_{2x}$— or a salt thereof, wherein $(C_xH_{2x}O)_n$ is $(C_2H_4O)_n$—, $(C_3H_6O)_n$— or $(C_2H_4O)_p$—, $(C_3H_6O)_q$—; R' is H or ArCO; Ar is mono- or bicyclic aryl of up to 15 carbon atoms; x is 2 or 3; n is 2-22 and the sum of p+q is n.

14. The process as in claim 1, further comprising the step of rinsing the dyeable material after contact with the dye composition to remove excess dye composition from the dyeable material.

15. The process as in claim 14, wherein the dyeable material is rinsed in a non-reactive, substantially oxygen-free atmosphere.

16. The process as in claim 15, wherein the non-reactive atmosphere is a vapor in the dyeing step and a liquid in the rinse step.

17. The process as in claim 15, wherein the non-reactive atmosphere is selected from the group consisting of fluorocarbons, halogenated hydrocarbons, inert gases, low boiling alcohols, organic solvents, nitrogen, carbon dioxide, and combinations thereof.

18. The process as in claim 14, further comprising the step of drying the dyeable material after contact with the dye composition and rinsing of the dye composition.

19. The process as in claim 18, wherein the dyeable material is dried in a non-reactive, substantially oxygen-free atmosphere.

20. The process as in claim 19, wherein the non-reactive atmosphere is selected from the group consisting of fluorocarbons, halogenated hydrocarbons, inert gases, low boiling alcohols, organic solvents, nitrogen, carbon dioxide, and combinations thereof.

21. The process as in claim 1, wherein the dyeable material is a textile material.

22. The process as in claim 21, wherein the textile material is a synthetic material.

23. The process as in claim 22, wherein in the contacting step the dye composition is at a temperature above the glass transition temperature of the synthetic material, but below both the melting point temperature of the synthetic material and the boiling point temperature of the dye composition.

24. The process as in claim 22, wherein the synthetic material is selected from the group consisting of polyesters, polyamides, polyurethanes, acrylics, halogenated polyolefins, polyolefins, aramids, and epoxy plastics.

25. The process as in claim 21, wherein the textile material is a natural material.

26. The process as in claim 1, wherein the dye composition is prepared and heated in a non-reactive, substantially oxygen-free atmosphere.

27. A non-aqueous process for the dyeing of a dyeable material comprising the steps of:

(a) preheating the dyeable material;

(b) contacting the preheated dyeable material with a dye composition in a non-reactive, subatantially oxygen-free atmosphere, the dye composition temperature and the time of contact between the dye composition and the dyeable material being sufficient to effectuate the dyeing of the dyeable material with the dye composition being at a temperature equal to or greater than the temperature at which dye degredation occurs in an oxygen containing atmosphere, the dye composition comprising a substantially non-aqueous solvent having a boiling point of at least 100° C. and a dyestuff soluble in the solvent, the solvent being selected from the group consisting of aromatic esters, cycloaliphatic diesters, and triglycerides, the non-reactive atmosphere being selected from the group consisting of fluorocarbons and halogenated hydrocarbons;

(c) removing the dye composition from contact with the dyeable material;

(d) cooling the dyeable material; and (e) recycling the dye composition removed in step (c) to contact the dyeable material in step (b).

28. The process as in claim 27, wherein the dyeable material is preheated in a non-reactive, substantially oxygen-free atmosphere by passing heated fluorocarbon or halogenated hydrocarbon gas over the dyeable material.

29. The process as in claim 27, wherein the dyeable material is cooled in a non-reactive, substantially oxygen-free atmosphere by passing fluorocarbons or halogenated hydrocarbon in the gaseous state over the dyeable material.

30. The process as in claim 27, further comprising the step of rinsing the cooled dyeable material by passing fluorocarbon or halogenated hydrocarbon liquid over the dyeable material to remove excess dye composition from the dyeable material.

31. The process as in claim 30, further comprising the step of drying the rinsed dyeable material by passing heated fluorocarbon or halogenated hydrocarbon gas over the dyeable material.

32. The process as in claim 27, wherein the dyeable material is a textile material.

33. The process as in claim 32, wherein the textile material is a synthetic material.

34. The process as in claim 33, wherein the synthetic material is selected from the group consisting of polyesters, polyamides, polyurethanes, acrylics, halogenated polyolefins, polyolefins, aramids, and epoxy plastics.

35. The process as in claim 1, wherein the aromatic ester is of the formula: $ArCOOR_2$, $ArCOO\text{-}R_1$ —OOCAr or $(ArCOO)_z$—$R_3$, wherein $R_1$ is alkylene of 2–8 carbon atoms of polyoxyalkylene of the formula —$C_rH_{2r}(OC_rH_{2r})_s$, in which r is 2 or 3 and s is up to 15; $R_2$ is substituted or unsubstituted alkyl or alkenyl of 8–30 carbon atoms; $R_3$ is the residue of a polyhydric alcohol having z hydroxyl groups; Ar is mono- or bicyclic aryl of up to 15 carbon atoms and z is 3–6.

36. The process as in claim 1, wherein cycloaliphatic ester is of the formula:

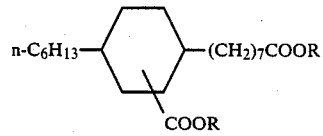

wherein R is substituted or unsubstituted straight or branched chain alkyl of 4–20 carbon atoms, polyoxyalkylene of the formula $R'(OC_xH_{2x})_n$ or phosphated polyoxyalkylene of the formula $(HO)_2P(=O)(OC_xH_{2x})_nOC_xH_{2x}$— or a salt thereof, wherein $(C_xH_{2x}O)_n$ is $(C_2H_4O)_n$—, $(C_3H_6O)_n$— or $(C_2H_4O)_p$—, $(C_3H_6O)_q$—; R' is H or ArCO; Ar is mono- or bicyclic aryl of up to 15 carbon atoms; x is 2 or 3; n is 2–22 and the sum of p +q is n.

37. The process as in claim 27, wherein the dye composition is heated in a non-reactive, substantially oxygen-free atmosphere being selected from the group consisting of fluorocarbons and halogenated hydrocarbons.

38. The process as in claim 27, wherein the dyestuff is selected from the group consisting of disperse, vat, reactive, direct, acid, basic, sulfur, and pigment.

39. The process as in claim 38, wherein the dye composition further comprises an additive selected from the group consisting of levelers, dye carriers, and organic finishing agents.

40. The process as in claim 1, wherein the glyceride is vegetable oil.

41. The process as in claim 40, wherein the vegetable oil is corn oil.

42. The process as in claim 30, wherein the glyceride is vegetable oil.

43. The process as in claim 42, wherein the vegetable oil is corn oil.

44. The process as in claim 37 wherein the dye composition is at a temperature above the glass transiton temperature of the synthetic material, but below both the melting point temperature of the synthetic material and the boiling point temperature of the dye composition.

* * * * *